US005614312A

United States Patent [19]

Tucker et al.

[11] Patent Number: 5,614,312

[45] Date of Patent: Mar. 25, 1997

[54] WET-LAID SHEET MATERIAL AND COMPOSITES THEREOF

[75] Inventors: Kenneth W. Tucker, Ponca City, Okla.; Gregory P. Weeks, Hockessin, Del.

[73] Assignee: E. I. Du Pont de Nemours and Company, Wilmington, Del.

[21] Appl. No.: 495,243

[22] Filed: Jun. 27, 1995

Related U.S. Application Data

[63] Continuation of Ser. No. 59,148, May 7, 1993, abandoned.

[51] Int. Cl.[6] ..... B32B 5/16

[52] U.S. Cl. ..... 428/323; 428/408; 442/344

[58] Field of Search ..... 428/323, 281, 428/283, 288, 289, 290, 297, 408

[56] References Cited

U.S. PATENT DOCUMENTS

| | | | |
|---|---|---|---|
| 3,622,445 | 11/1971 | Heidweiller | 162/145 |
| 3,761,047 | 9/1973 | Mao | 249/115 |
| 3,923,697 | 12/1975 | Ellis | 252/506 |
| 4,002,724 | 1/1977 | Mckie | 423/243.08 |
| 4,471,015 | 9/1984 | Ebneth et al. | 428/195 |
| 4,615,853 | 10/1986 | Aoyama et al. | 264/122 |
| 4,913,774 | 4/1990 | Gogeulin | 162/158 |
| 4,929,308 | 5/1990 | Gerault et al. | 162/145 |
| 4,952,448 | 8/1990 | Bullock et al. | 428/323 |
| 5,004,561 | 4/1991 | Nomura et al. | 252/511 |
| 5,134,016 | 7/1992 | Geary, Jr. et al. | 428/198 |
| 5,194,106 | 3/1993 | Geary, Jr. et al. | 156/65.6 |
| 5,260,124 | 11/1993 | Gaier | 428/257 |
| B1 4,495,030 | 1/1990 | Giglia | 162/145 |

FOREIGN PATENT DOCUMENTS

| | | |
|---|---|---|
| 0341977 | 11/1989 | European Pat. Off. . |
| 61-99803 | 3/1986 | Japan . |
| 2031924 | 4/1980 | United Kingdom . |
| 8704476 | 7/1987 | WIPO . |

OTHER PUBLICATIONS

PCT/US94/03083—International Search Report dated Jul. 13, 1994.

Anonymous Disclosure, "Vapor–Grown Graphite or Carbon Fibrils Generated Via Carbonizable Liquid Feedstocks from Orifies (Pores) in Petroleum Coke", *Research Disclosure*, 667, Sep. 1991.

A. Sarkar and T.L. Peterson, "Fabrication and Electrical Properties of Ceramic Superconductor/Polymer Composites", *Polymer Engineering and Science*, 32:5, 305–309, Mid Mar. 1992.

D.M. Bigg, "Conductive Polymeric Compositions", *Polymer Engineering Science*, 17:12, 842–847, Dec. 1977.

D.M. Bigg and E.J. Bradbury, "Conductive Polymeric Composites From Short Conductive Fibers" *Polymer Science and Technology*, Conductive Polymers–Plenum Press, R.B. Seymore Ed., 15,23, 1981.

D.M. Bigg, "The Effect of Compounding on the Conductive Properties of EMI Shielding Compounds", *Advances in Polymer Technology*, 4:3/4, 255–266.

S.R. Gerteisen and K.J. Nangrani, "Plastics That Shield Against EMI/RFI", *Society of Plastic Engineers, Inc., Chicago Section Electric and Electronics Division, Rosemont IL*, Jun. 20–22, 1988.

S.J. Kidd, "Stainless Steel Composites For EMI Shielding–Characterization, Specification and Quality Assurance", *Society of Plastic Engineers, Inc. Chicago Section Electric and Electronics Division, Rosemont IL*, Jun. 20–22, 1988.

M. Murthy, "Nickel Coated Graphite Fiber Shielding", *Society of Plastic Engineers, Inc., Chicago Section Electric and Electronics Division, Rosemont IL*, Jun. 20–22, 1988.

R. Simon, "Thermally and Electrically Conductive Flake Filled Plastics", *Polymer News*, 11, 102–108, 1985.

D.M. Bigg, "Thermally Conductive Polymer Compositions", *Polymer Composites*, 7:3, 125–135, Jun. 1986.

J.P. Issi, B. Nysten, A. Jones, A. Demain, L. Piraux and B. Poulaert, "Tailoring The Thermal Conductivity of Organic Materials", *Thermal Conductivity 21, C.J. Creamers and H.A. Fine Eds., Plenum Press, NY*, 629–646, 1990.

L. Piraux, E. Ducarme and J.P. Issi, "Thermal Conductivity of Oriented Polyacetylene Films", *Synthetic Metals*, 41–43, 129–132, 1991.

D.E. Davenport, "Metalloplastics–High Conductivity Materials", *Polymer Science and Technology*, 15, 39–47, 1981.

R.M. Simon, "Plastics As Current and Heat Conductors", *Polymer Science and Technology*, 15, 51–59, 1981.

B. Nyston, A. Jonas, J. Issi, "Effect of Carbopn Fibers Length on the Low Temperature Thermal Conductivity of a Thermoplastic Composite", *Thermal Conductivity 21*, C.J. Cremers and H.A. Fine Eds., Plenum Press, NY, 647–660, 1990.

*Primary Examiner*—Kathleen Choi

[57] ABSTRACT

This invention relates to a wet-laid sheet material prepared from thermoplastic fibers, graphite particles, reinforcing fibers, and microglass fibers. The sheet material is useful in making compression molded composite plaques, said plaques being thermally and electrically conductive.

9 Claims, 1 Drawing Sheet

WET-LAID SHEET MATERIAL AND COMPOSITES THEREOF

This is a continuation of application Ser. No. 08/059,148, filed May 7, 1993, now abandoned.

BACKGROUND

The present invention relates to a wet-laid sheet material that is especially useful in forming compression molded composite plaques, said plaques being thermally and electrically conductive. More specifically, it relates to a wet-laid sheet material prepared from thermoplastic fibers, graphite particles, reinforcing fiber, and microglass fiber, and to composite plaques formed therefrom.

There currently exists a need for economical polymer systems having increased thermal and electrical conductivity capabilities. There have been various approaches in the past used to increase the thermal and electrical conductivity of polymer systems. One such approach involves increasing the conductivity of the polymer itself. However, the resultant intrinsically conductive polymer matrix has been found to be difficult and expensive to produce. Another approach involves coating the polymer with a thin layer of metal, such as silver or copper. Again, such an approach is not ideal because it is expensive (especially if preplating or priming is needed) and further because the metal coating could cause corrosion problems and could result in delamination due to thermal cycling. Finally, another approach involves adding conductive fillers to the polymer, such as carbon black, nickel-coated graphite fibers, nickel-coated glass fibers, stainless steel fibers, aluminum coated glass fibers, aluminum fibers, copper powder and flakes, and aluminum powder and flakes. However, such fillers can be expensive, difficult to process, subject to corrosion, and can cause resultant polymer system to be non-economical.

In the present invention, it was found that an economical polymer system could be made that had surprisingly good thermal and electrical conductivity. The system is a wet-laid sheet material made from a thermoplastic fiber, graphite particles for conductivity, reinforcing fibers for obtaining good physical properties, and microglass fiber to aid in retention of the graphite particles in the sheet materials. Wet-laid sheet materials are described in U.S. Pat. No. 5,134,016 as fiber reinforced porous sheets. However, this patent does not disclose sheets, or composite plaques made from them, that are thermally and electrically conductive, that contain graphite particles for conductivity, and that contain microglass fibers to aid in the retention of the graphite particles in the wet-laid sheet material.

The wet-laid sheet materials can be stacked and compression molded to form a composite plaque. The resultant plaque is found to have excellent transverse thermal conductivity and electrical conductivity, as shown by the examples herein. Comparable neat thermoplastic polymers, on average, have an average volume electrical resistivity of $10^{12}$–$10^{15}$, with some being even higher, and an average transverse thermal conductivity of about 0.2–0.3 W/mK. The materials of the present invention, as illustrated by the examples, have significantly improved conductivity values compared to comparable neat polymers.

The wet-laid sheet material of the present invention is useful in forming molded composite parts for use in applications requiring thermally and electrically conductive materials, such as heat sink applications (i.e., pump housings, power supplies for personal computers, light ballasts, encapsulation of electrical devices and parts thereof (including transformers), etc.), static dissipative or electromagnetic interference/radio frequency interference shielding applications, electrical grounding applications, electrical measuring devices (such as potentiometers), and electromagnetic radiation reflecting applications (e.g., antennae, etc.).

SUMMARY OF THE INVENTION

Figure 1:
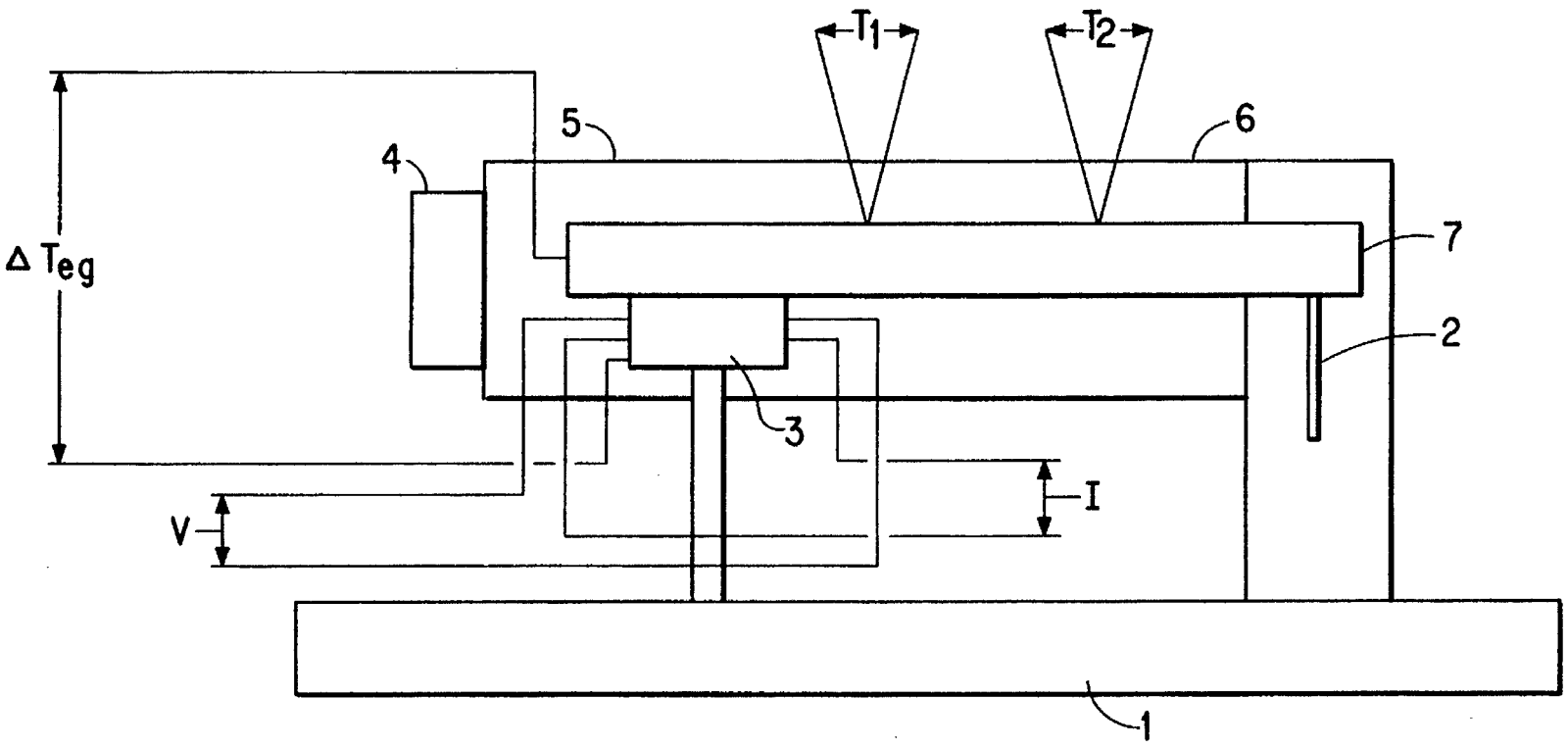
FIG. 1 is a diagram of a thermal conductivity measuring device based upon a four probe technique, as described in the Examples below.

The present invention relates to a wet-laid sheet material comprised of (a) thermoplastic fibers or globules or both, (b) 20–70 weight percent graphite particles, (c) 5–20 weight percent reinforcing fibers, and (d) 0.5–3 weight percent microglass fibers, wherein the weight percents given above are based upon the total weight of components (a), (b), (c), and (d) only, wherein the weight percent of the thermoplastic fiber component is sufficient to make the total weight percent of components (a), (b), (c), and (d) equal 100 weight percent. The sheet material, and stacks thereof, is useful in applications where thermal and/or electric conductivity is desired, such as, for example, heat sink applications, electromagnetic interference shielding applications, etc.

DETAILED DESCRIPTION OF THE INVENTION

The present invention relates to a wet-laid sheet material comprised of (a) thermoplastic fibers or globules or both, (b) 20–70 weight percent graphite particles, (c) 5–20 weight percent reinforcing fibers, and (d) 0.5–3 weight percent microglass fibers.

Preferably, the wet-laid sheet material is comprised of 30–60 weight percent component (b), 5–15 weight percent component (c), and 0.5–3 weight percent component (d). Most preferably, it is comprised of 35–55 weight percent component (b), 7–15 weight percent component (c), and 0.5–3 weight percent component (c). In each of the above, the weight percent of component (a) is sufficient to bring the total weight of components (a), (b), (c), and (d) to 100 weight percent. The weight percents given above are based upon the total weight of components (a), (b), (c), and (d) only.

The component (a) thermoplastic fibers include, but are not limited to, polyester fibers, polyamide fibers, polypropylene fibers, copolyetherester fibers, polyethylene terephthalate fibers, polybutylene terephthalate fibers, polyetherketoneketone (PEKK) fibers, polyetheretherketone (PEEK) fibers, liquid crystalline polymer (LCP) fibers, and mixtures thereof. Polyamide fibers include, but are not limited to, nylon 6, 66, 11, 12, 612, and high temperature "nylons" (such as nylon 46). The thermoplastic fibers are generally fine (about 0.5–20 denier), short (about 1–5 cm), staple fibers, possibly containing precompounded conventional additives, such as antioxidant, stabilizers, lubricants, tougheners, etc. In addition, the thermoplastic fibers may be surface treated with a dispersing aid. The preferred thermoplastic fibers are polyamide and polyethylene terephthalate fibers, with the most preferred being polyethylene terephthalate fibers. The thermoplastic globules originate from the thermoplastic fibers when they are melted during manufacture of the wet-laid sheet material, which is described below.

The component (b) graphite particles can be natural or synthetic graphite particles, but in either case, generally are −35 Tyler mesh in particle size. Preferably, the graphite particle size is −35 Tyler mesh, with at least 85% of the particles being greater than 400 Tyler mesh. The most preferred graphite particles have a −35/+100 Tyler mesh size range. Tyler mesh values can be correlated to particle size by those skilled in the art. Specific terminology to describe graphite particles useful herein include graphite powder, graphite/coke mixtures, scrap graphite, natural graphite, natural/synthetic graphite mixtures, graphite fines, and graphitized petroleum coke. The preferred graphite particles are graphitized premium petroleum coke particles (graphitized at greater than 2500° C., preferably 2700°–3100° C.) and electrode-grade scrap graphite. The most preferred graphite particles are premium petroleum coke particles graphitized at about 2700°–3100° C.

The component (c) reinforcing fibers include, but are not limited to, glass fibers, carbon fibers, metal fibers, polyaramid fibers (such as Kevlar®), and metal whiskers, with carbon fibers and glass fibers being preferred. The most preferred reinforcing fibers are long E glass fibers, having an average length of 0.25–1.5 inches, preferably about 0.5–1 inch, which are commercially available. The diameter of the E glass fibers is generally 10–20 microns, preferably 12–16 microns. The reinforcing fibers are generally used for imparting good tensile strength to the wet-laid sheet material.

The component (d) microglass fibers are used primarily to aid in retention of the graphite particles in the sheet material. Currently, the microglass fibers are usually in the form of a filter-type sheet material. When the wet-laid sheet material is prepared, the filter-type sheet material is broken up during mixing to yield the microglass fibers. The microglass fiber in the wet-laid sheet material is generally shorter and thinner than the glass reinforcing fibers. The length of the microglass fibers generally ranges from 20 microns to 0.25 inches and the width generally ranges from 0.3–4 microns. Preferably, the majority of the microglass fibers have a diameter of 0.3–1.0 microns and an aspect ratio of 100/1 or greater.

The wet-laid sheet material of the present invention can be made by techniques readily available to those skilled in the art, such as a traditional paper-making process or as described in U.S. Pat. No. 5,134,016 or European Patent Publication No. 341977. In a preferred method of making the wet-laid sheet material, at least components (a), (b), (c), and (d) are mixed with water to form an aqueous suspension. The aqueous suspension can be blended in a pulper to ensure uniformity. The aqueous suspension is then applied to a porous substrate (usually an endless belt or screen) to form a porous sheet material, or web. An example of an acceptable screen, depending on the particle size of the graphite (especially if it is between −100 and −65 Tyler mesh), is Duotex 116 mesh screen. The porous substrate should have holes that are not so big that a substantial amount of graphite particles in the wet-laid sheet material would pass through them. The porous sheet material is then dried, for example in a rotary through air or forced air bonder dryer, and heated at a temperature high enough to cause the water to evaporate and the thermoplastic fiber to melt (but low enough to prevent degradation), thereby resulting in adherence of the thermoplastic fiber to the reinforcing fiber and graphite particles in the wet-laid sheet material. In the resulting wet-laid sheet material, the thermoplastic fiber may resemble "globules" after melting of the thermoplastic fibers. Globules are defined in U.S. Pat. No. 5,134,016, incorporated hereby by reference. The globules formed are not necessarily spherical in shape as the term may imply, but rather they are really lumps of previously molten thermoplastic fiber.

From the wet-laid sheet material, which has been heated and dried, a composite sheet or plaque can be prepared via compression molding techniques, such as those described in U.S. Pat. No. 5,134,016 (especially column 4), already incorporated herein by reference. In doing so, several individual wet-laid sheet materials are stacked together to produce a thickness suitable for molding. Optionally, the sheet materials can be mechanically sewn together for easier processing. The stack of sheet materials are placed in a mold having a desired design. Predrying may be required, starting at room temperature and using slow cycle molding. When condensation polymers, such as polyethylene terephthalate, are used as the thermoplastic fiber component, it is recommended that the stack of sheet materials be dried to less than a 0.02% moisture level prior to molding. The mold containing the stack of sheet materials is placed in a heated platen press, where temperature is raised and pressure is increased to amounts sufficient for the thermoplastic fiber to have some melt flow. Then, the mold and its contents are cooled under pressure. The resulting composite plaque is then removed and evaluated for future use.

EXAMPLES

The examples given below are set forth for the purpose of illustration only and are not to be construed as limitations on the present invention. Unless otherwise specified, all percentages are by weight, as based upon the total weight of all constituents.

Examples 1–25

The components used in examples 1–25 are described below.

"PET fiber" was a polyethylene terephthalate fiber (sold commercially by E. I. du Pont de Nemours and Company as Dacron®) containing 0.35%–1% antioxidant. The fibers, on average, had a length of about ¼ inch and a diameter of about 13 microns.

Except for Examples 12 and 13, "Graphite" was graphitized (at 3000° C.) premium petroleum coke particles. The size of the particles is given in the Tables below, based upon Tyler mesh sieve analysis. The graphite used in Examples 12 and 13 is described in Table 1A, below. In Examples 16–25, the graphite was from the same lot of material.

"E-glass" was E glass fiber (K diameter: 12.7 to 13.9 microns) that was commercially available from Owens Corning Fiberglass as 133A-AB. It was used in the form of chopped strands and it had a polyurethane sizing on the fiber surface. The average E-glass length is provided in the Tables below.

"Carbon fiber" was carbon fiber as described in U.S. Pat. No. 4,861,653.

"Microglass" was binderless high efficiency filter medium microglass fiber commercially available from Hollingsworth and Vose Company as HB-5341. It was used in the form of 18-inch wide sheets, which, upon agitation, broke up into individual fibers. The diameter of the individual fibers varied from 0.3 to 4 microns and the length of the individual fibers varied from 20 microns to over 1 inch.

In the examples below, the wet-laid materials were generally made by the same process. Fifty pounds of each formulation were dispersed in 1000 gallons of water to create a slurry. Specifically, PET fiber was added first to the water and mixed for about 10 minutes. Reinforcing fiber was added next and mixed for about 2–3 minutes. Microglass filter medium, in paper form, was torn into small pieces and added to the slurry. Finally, graphitized coke was added to the slurry. The slurry, having first been diluted with 900 gallons/minute of recirculating water in the usual manner, was fed at a rate of 100 gallons per minute to the forming box of an inclining wire paper machine equipped with Duotex synthetic 116 mesh wire. Collected sheet material was dried and heated at 277° C. for about 30 seconds to evaporate water and melt the thermoplastic fiber. The wet-laid dried and heated sheet material was then rolled for storage purposes.

At a later time, the rolled wet-laid sheet material was unrolled and cut into 10.5-inch by 10.5-inch sheets to be pressed into higher density composite plaques having fewer loose fibers. Approximately 1 lb. of the 10.5-inch by 10.5-inch dried wet-laid sheet material (to make a plaque approximately ⅛ inch thick) was further dried for 16 hours in a vacuum oven at 4-inch Hg absolute pressure and 105° C. under a nitrogen purge. This further dried material (<0.02% water) was then stacked in a 10.5-inch by 10.5-inch mold. A vacuum was applied to the mold to remove any vapors (such as water). The assembly was placed in a 50 ton hydraulic press and pressed at 907 psi and 277° C. (mold temperature) for 10 minutes. After the expiration of said 10 minutes, the platen heaters were turned off and allowed to cool. The pressure of 907 psi was maintained until the mold temperature reached 200° C. Then the pressure was allowed to decrease as the temperature of the mold decreased further. When the mold temperature reached 30° C., the platens were opened and the assembly was removed from the press. The composite plaque was then removed from the mold.

The composite plaques described above were tested for transverse thermal conductivity, volume electrical resistivity, and tensile properties.

Transverse thermal conductivity was determined as follows: test specimen were cut from the composite plaques prepared above. The test specimen had a diameter of 2 inches and a thickness of ⅛ inch. These test specimen were tested using a Dynatech (Holometrix) TCHM-DV C-Matic to measure the transverse thermal conductivity through-the-thickness of the specimen. The guarded heat flow meter method (ASTM Standard F433) was used and all measurements were conducted nominally at 50° C. Increasing thermal conductivity values indicate increasing ability to transfer heat. The density of the specimen was measured using ASTM D792.

Volume electrical resistivity was determined as follows: test specimen (2 mm wide by 2 mm thick by 25.4 mm long) were cut from the composite plaques described above. In the test method, a constant current was sent across the test specimen. The voltage drop was measured across the center 6 mm of the test specimen. One measurement was taken for each specimen. All specimen were tested at ambient conditions. Decreasing volume electrical resistivity values indicate increasing electrical conductivity.

Tensile properties were determined as follows: test specimen (6.5 inches long, 0.75 inches wide) were cut from the composite plaques described above. These specimen were routed into a "dog-bone" shape so that the gauge length was 2.0 inches and the gauge width was 0.5 inches. The specimen were placed in a screw action mechanical grip. A piece of 180 grit sandpaper was placed around the grip sections of the tensile specimen, with the rough side touching the specimen. The sandpaper helped to keep the specimen from slipping out of the grips. All specimen were tested according to ASTM Standard D638, at ambient conditions. An Instron 4202 testing machine was used. The crosshead speed was held constant at 0.2 inches/minute. Tensile results are reported below under elongation and maximum tensile strength.

The compositions of the wet-laid sheet materials used to make the composite plaques for the examples, along with the test results thereto, are given in the Table 1A and 1B below. In the Tables below, transverse thermal conductivity is reported as "Ave TC (W/mK) (Trans.)" and volume electrical resistivity is reported as "Ave Vol ER (ohm-cm)".

TABLE 1A

| | Wet-Laid Sheet Material Ingredients, wt % | | | | | |
|---|---|---|---|---|---|---|
| Eg. No. | PET Fiber | Graphite | Reinforcing Fiber | Microglass | Graphite Tyler Mesh Size | E-glass Length (in) |
| 1 | 45 | 45 | 7E | 3 | −100 | 1 |
| 2 | 45 | 45 | 7E | 3 | −80 | 1 |
| 3 | 40 | 50 | 7E | 3 | −100 | 1 |
| 4 | 40 | 50 | 7E | 3 | −100 | 0.75 |
| 5 | 40 | 50 | 9E | 1 | −100 | 0.75 |
| 6 | 40 | 50 | 9E | 1 | −80 | 0.75 |
| 7 | 40 | 50 | 9E | 1 | −80 | 0.75 |
| 8 | 35 | 55 | 9E | 1 | −100 | 0.75 |
| 9 | 35 | 55 | 9E | 1 | −80 | 0.75 |
| 10 | 40 | 50 | 9E | 1 | −65 | 0.75 |
| 11 | 45 | 45 | 9E | 1 | −65 | 0.75 |
| 12 | 49 | 30 | 20C | 1 | −80 | — |
| 13 | 40 | 50 (1) | 9E | 1 | −80 | 1 |
| 14 | 40 | 50 (2) | 9E | 1 | −80 | 1 |
| 15 | 40 | 50 | 9E | 1 | −80/+100 | 1 |
| 16 | 55 | 35 | 9E | 1 | −80 | 1 |
| 17 | 55 | 35 | 9E | 1 | −80 | 0.5 |
| 18 | 50 | 40 | 9E | 1 | −80 | 1 |
| 19 | 50 | 40 | 9E | 1 | −80 | 0.5 |
| 20 | 40 | 50 | 9E | 1 | −80 | 1 |
| 21 | 40 | 50 | 9E | 1 | −80 | 0.5 |
| 22 | 34 | 50 | 15E | 1 | −80 | 0.5 |
| 23 | 37 | 50 | 12E | 1 | −80 | 0.5 |
| 24 | 40 | 50 | 8E | 2 | −80 | 0.5 |
| 25 | 40 | 50 | 8E | 2 | −80 | 1 |

(1) Electrode-grade scrap graphite
(2) Graphitized anode-grade (regular) coke
E = E-glass
C = Carbon Fiber

TABLE 1B

| Eg. No. | Ave TC (W/mK) (Trans.) | Ave Vol ER (ohm-cm) | Tensile Strength (kpsi) | Elong. @ break (%) | Density (g/cc) |
|---|---|---|---|---|---|
| 1 | 1.99 | 0.22 | 9.82 | 1.15 | 1.77 |
| 2 | 2.67 | 0.17 | 9.67 | 0.96 | 1.77 |
| 3 | 3.39 | 0.06 | 7.94 | 0.60 | 1.82 |
| 4 | 3.46 | 0.04 | 7.47 | 0.55 | 1.83 |
| 5 | 3.29 | 0.06 | 8.59 | 0.74 | 1.88 |
| 6 | 3.45 | 0.04 | 9.22 | 0.97 | 1.81 |
| 7 | 1.85 | 0.18 | 10.87 | 1.08 | 1.75 |
| 8 | 1.90 | 0.01 | 8.31 | 0.89 | 1.90 |
| 9 | 1.87 | 0.02 | 10.61 | 1.16 | 1.87 |
| 10 | 3.82 | 0.03 | 9.55 | 0.96 | 1.83 |
| 11 | 3.00 | 0.06 | 9.01 | 0.94 | 1.80 |
| 12 | 1.04 | 0.01 | 14.92 | 0.62 | 1.61 |
| 13 | 3.69 | 0.07 | 5.49 | 0.55 | 1.80 |

TABLE 1B-continued

| Eg. No. | Ave TC (W/mK) (Trans.) | Ave Vol ER (ohm-cm) | Tensile Strength (kpsi) | Elong. @ break (%) | Density (g/cc) |
|---|---|---|---|---|---|
| 14 | 2.56 | 0.06 | 9.05 | 0.88 | 1.72 |
| 15 | 3.77 | 0.01 | 7.43 | 0.52 | 1.81 |
| 16 | 0.91 | 5.22 | 7.76 | 0.69 | 1.65 |
| 17 | 1.04 | 2.07 | 9.22 | 1.30 | 1.66 |
| 18 | 1.34 | 0.48 | 8.35 | 1.06 | 1.70 |
| 19 | 1.55 | 0.51 | 7.13 | 1.26 | 1.73 |
| 20 | 1.88 | 0.07 | 9.33 | 1.20 | 1.77 |
| 21 | 2.38 | 0.06 | 8.12 | 0.82 | 1.78 |
| 22 | 3.30 | 0.02 | 10.31 | 1.41 | 1.87 |
| 23 | 2.26 | 0.04 | 9.34 | 1.11 | 1.81 |
| 24 | 2.40 | 0.05 | 7.06 | 0.55 | 1.77 |
| 25 | 1.77 | 0.10 | 7.48 | 0.59 | 1.74 |

The results reported in Table 1B above show that the composite plaques made from the wet-laid sheet material of the examples had excellent thermal and electrical conductivity values. The average conductivity values for comparable neat polymers are given in the text above.

Comparison of Composite Plaques vs. Injection Molded Composition

In Table 2 below, the composite plaque of Example 3, above, is compared to similar types of materials that were injection molded.

For the injection molded materials in Table 2, "Graphite" was the same as those described above and used in the wet-laid sheet materials. "E-glass" was a commercial glass reinforcing product (PPG 3540, sold by PPG Industries) having an average length of ⅛ inch. "PET resin" was a commercially available PET containing conventional additives (antioxidant, plasticizer, and solid epoxy resin; sold under the name Rynite® (E. I. du Pont de Nemours and Company)). The injection molded compositions were prepared by melt compounding all ingredients and extruding the compounded material on a 46 mm Buss kneader extruder. The resultant product was pelletized and injection molded into test specimen on a 6 oz. "A" molding machine.

Transverse conductivity values and in-plane conductivity values for the injection molded compositions and the composite plaque are reported in Table 2, below.

The transverse conductivity test is described above.

In-plane (longitudinal) conductivity was determined using a four probe technique (FIG. 1). Test samples, having dimensions 32 mm×5 mm×3 mm (l×w×thickness) were cut front the composite plaque above. For the injection molded compositions, test samples were molded into parts having dimensions 32 mm×5 mm×3 mm (l×w×thickness). At one end of the sample (7), a heater [called sample heater (3)] was glued in good thermal contact by means of a silver paint. At the other end of the sample, the sample was pressed to a heat sink (1) by means of a screw (2). When the sample heater is energized, the generated heat flows through the sample from the sample heater to the sink.

The difference in temperature ($\Delta T=T_1-T_2$) on the sample was measured by means of two chromel-constantan thermocouples ($T_1$ and $T_2$). Each one read the difference in temperature between one point on the sample and one on the sink. The difference in temperature on the sample was then given by the difference between the two preceding values. The junction of each thermocouple was inserted in a small hole drilled in the sample. Thermal contact was assured by means of a silver paint. The other extremities were wound around the sink to insure good thermal anchoring and electrical insulation.

The temperature sensor reading ($\Delta T_{cg}$) was a chromel-constantan-chromel thermocouple. One of the junctions was soldered on the sample heater, while the other was thermally anchored on a copper guard (5) facing the sample heater. The extremities of this thermocouple were also thermally anchored to the sink.

The heaters were made of hollow copper blocks in which small electrical resistors were inserted and glued. The power generated in the heater was evaluated by multiplying the current (I) flowing through the resistor by the voltage drop (V) across the resistor. The thermal conductivity is then given by:

$$K=\frac{V\times I}{\Delta T}\times\frac{d}{S}$$

where d is the distance between the two junctions of the thermocouples on the sample (in this case, 8 mm) and S is the cross-section of the sample. All voltages were measured by means of a Keithley 195A voltmeter and currents with a Keithley 177 ammeter. The system was completely monitored by computer.

The results show that the in-plane conductivity on the composite plaque was significantly greater (almost 3 times greater) than the in-plane conductivity for the injection molded composition. For optimal conductivity, it is desirable to have both high transverse conductivity values and high in-plane conductivity values.

TABLE 2

| Type | Graphite (wt %) | Tyler Mesh Graphite | E-Glass (wt %) | E-Glass Length (in) | Micro-glass (wt %) | PET (wt %) | Conductivity In-Plane (W/m-K) | Conductivity Transverse (M/m-K) |
|---|---|---|---|---|---|---|---|---|
| IM-1 | 50 | −80 | 10 | ⅛ | — | 40 (1) | 10.7 | 3 |
| IM-2 | 35 | −80 | 10 | ⅛ | — | 55 (1) | 5.7 | 1.5 |
| IM-3 | 50 | −80 | 10 | ⅛ | — | 40 (1) | 9 | 2.89 |
| CM-3 | 50 | −100 | 7 | 1 | 3 | 40 (2) | 30 | 3.4 |

IM = Injection molded material
CM = Composite material
(1) = PET resin
(2) = PET Fiber

We claim:

1. A wet-laid sheet material comprising (a) thermoplastic fibers or globules or both, (b) 20–70 weight percent graphite particles having a particle size of –35 Tyler mesh, (c) 5–20 weight percent reinforcing fibers, and (d) 0.5–3 weight percent microglass fibers, wherein the weight percents are based upon the total weight of components (a), (b), (c), and (d) only and wherein the weight percent of the component (a) is sufficient to make the combined weight percents of component (a), (b), (c), and (d) total 100 weight percent.

2. The wet-laid sheet material of claim 1 wherein the thermoplastic is selected frown the group consisting of polyester, polyamide, polypropylene, polyethylene terephthalate, polybutylene terephthalate, liquid crystalline polymer, polyetherether ketone, polyetherketoneketone, and mixtures thereof.

3. The wet-laid sheet material of claim 1 wherein the thermoplastic is polyethylene terephthalate.

4. The wet-laid sheet material of claim 1 wherein the graphite particles are premium petroleum coke particles graphitized at greater than 2500° C.

5. The wet-laid sheet material of claim 4 wherein graphitization is at 3000° C.

6. The wet-laid sheet material of claim 1 wherein the component (c) reinforcing fibers are selected from the group consisting of glass fibers, carbon fibers, metal fibers, polyaramid fibers, and metal whiskers.

7. The wet-laid sheet material of claim 1 wherein the component (c) reinforcing fibers are long E glass fibers.

8. The wet-laid sheet material of claim 1 made by a process comprising (a) forming an aqueous dispersion of components (a), (b), (c), and (d);

(b) applying the aqueous dispersion to a porous substrate to form a wet-laid sheet, and (c) heating the wet-laid sheet at a temperature high enough, and for a time period long enough, to melt the thermoplastic fiber component.

9. The wet-laid sheet material of claim 1 for use in heat sink applications, electrical grounding applications, static dissipative applications, electromagnetic radiation reflecting applications, electrical measuring device applications, and electromagnetic interference/radio frequency interference applications.

* * * * *